United States Patent [19]

Matsushita et al.

[11] 4,411,451

[45] Oct. 25, 1983

[54] PRESSURE SENSITIVE COPYING PAPER

[75] Inventors: Toshihiko Matsushita, Funabashi; Sadao Morishita, Ibaraki; Eiko Kamimura, Yoshikawamachi; Shigetoshi Hiraishi, Tokyo, all of Japan

[73] Assignee: Mitsubishi Paper Mills, Ltd., Tokyo, Japan

[21] Appl. No.: 292,126

[22] Filed: Aug. 12, 1981

[30] Foreign Application Priority Data

Aug. 28, 1980 [JP] Japan ..... 55-118845

[51] Int. Cl.[3] ..... B41M 5/22

[52] U.S. Cl. ..... 282/27.5; 428/320.6; 428/488; 428/537; 428/914

[58] Field of Search ..... 282/27.5; 427/150–152; 428/320.4, 320.6, 488, 537, 914

[56] References Cited

U.S. PATENT DOCUMENTS

| | | | |
|---|---|---|---|
| 3,554,781 | 1/1971 | Matsukawa | 282/27.5 |
| 4,171,981 | 10/1979 | Austin et al. | 282/27.5 |
| 4,269,893 | 5/1981 | Kato et al. | 282/27.5 |

*Primary Examiner*—Bruce H. Hess

*Attorney, Agent, or Firm*—Cushman, Darby & Cushman

[57] ABSTRACT

In a pressure sensitive copying paper comprising a color former coated sheet obtainable by coating an aqueous coating color constituted mainly of microcapsules containing a substantially colorless color former and of a protecting agent and a binder, the transferability of the color former onto the color developer coated sheet can be improved by adding a wax to said aqueous coating color in an amount of 3–15% by weight based on the solid content of the coating color.

2 Claims, No Drawings

PRESSURE SENSITIVE COPYING PAPER

This invention relates to a pressure sensitive copying paper. More particularly, it relates to a pressure sensitive copying paper improved in transferability of color forming agent onto color developing agent coated sheet.

There are hitherto known pressure sensitive copying papers in which are combined and used the so-called over sheet obtained by dissolving a colorless electron donating substance (color forming agent, hereinafter referred to as color former) into a non-volatile solvent, enveloping the resulting solution with a gelatin film or other polymer film to give microcapsules having a diameter ranging from several microns to some dozen microns and coating the microcapsules on the backside of a support; the so-called under sheet obtained by coating the front surface of a support with a coating color containing an electron accepting substance such as activated clay, phenolic resin or the like, capable of reacting and forming a color upon contact with the color forming agent (color developing agent, hereinafter referred to as color developer); and in some cases the so-called intermediate sheet obtained by coating the backside of a support with microcapsules containing color former and coating the front surface of the support with the coating color containing color developer. Apart from above, as special type, self contained paper is also known in which the microcapsules containing the color former and the color develper are both coated on the same surface of a support.

When they are superposed in order of over sheet—(intermediate sheet)—(intermediate sheet)—under sheet or the like and a local pressure of pencil or typewriter is applied thereto, the microcapsules at the part to which the external pressure has been applied are ruptured and the solution containing the color former is transferred into the layer of color develper, so that a color is formed and a copied image is obtained. In pressure sensitive copying papers consisting of an over sheet and an under sheet or of an over sheet, an intermediate sheet and an under sheet, the color former and the color developer are coated on separate sheet surfaces. Therefore, even though the transfer of color former takes place owing to the external pressure, the amount of color former transferred into the color developer layer of under sheet is ½ or less in general, and the efficiency is quite low. The color former not transferred is absorbed into the over sheet and remains there without contributing to color formation.

Microcapsules containing a color former are costly because the color former and the solvent for dissolving it are both expensive and the procedure of producing microcapsules is complicated and takes a long period of time.

Even if such costly microcapsules are used, to increase the amount of color former transferred into color developer layer and thereby to lessen the amount of microcapsule coating will contribute to the reduction of cost to a great extent, if it is possible.

In view of above, the present inventors conducted earnest studies to find that, in a pressure sensitive copying paper comprising a color former coated sheet obtained by coating an aqueous coating color constituted mainly of microcapsules containing a substantially colorless color former and of a protecting agent and a binder, the transferability of the color former to the color developer coated sheet can be improved by adding a wax to the aqueous coating color in an amount of 3–15% by weight based on the solid content of the coating color. The color former coated sheet i.e. over sheet or intermediate sheet is prepared by coating a support with microcapsules containing a color former and is constituted mainly of three components: color former, microcapsule-protecting agent and binder, wherein the protecting agent greater in size than microcapsule is for protecting the microcapsules easily broken by pressure and the binder is for fixing the microcapsules on the support. When the color former coated sheet is superposed on a color developer coated sheet and a pressure is applied thereto, the microcapsules in the coating layer of color former coated sheet are ruptured and the color former solution (a solution of color former in a solvent) contained therein is transferred into the color developer layer. Thus, both the agents come into contact to exhibit a color forming reaction.

However, even if the color developer layer has a considerably oil-absorbency, a large portion of the color former solution is absorbed into the coating layer of color former coated sheet and remain there so that it cannot contribute to the color formation. Although it is desirable that, when microcapsules are ruptured by pressure, the color former solution in the microcapsules is completely transferred onto the color developer coated sheet or onto its color developer layer, only ½ or less of the color former solution can be transferred actually. Among the various causes for it, the most important is that the coating layer of color former coated sheet has such a structure as to absorb the color former solution easily, or from a macroscopic point of view it has a so porous surface structure that it absorbs the color former solution into its microcapsule coating layer at a high speed and lets the solution permeate into the interstices of fibers of the support paper. Prevention of this phenomenon leads to an improvement in the transferability of color former.

The present inventors discovered that addition of a wax capable of giving oil repellency to the microcapsule coating layer is the most effective method for decreasing the ability of microcapsule coating layer to absorb the color former solution and to allow its permeation. Usually, a color former coated sheet is prepared by coating an aqueous coating color containing microcapsules, a protecting agent and a binder to a support. The wax of this invention is of aqueous type, so that it must be used in the form of an aqueous emulsion or an aqueous suspension. Particle diameter of the wax is preferably small to such an extent that it can form an emulsion. However, its combined use with a wax having a particle diameter of 2–3 microns capable of forming a suspension is more effective.

As the waxes usable in this invention, there can be referred to animal waxes such as beeswax, spermaceti, Chinese wax, lanolin and the like; vegetable waxes such as candelilla wax, carnauba wax, Japan wax, rice wax, sugar cane wax and the like; mineral waxes such as montan wax, ozokerite, ceresin, lignite wax and the like; petroleum waxes such as paraffin wax, micro-crystalline wax and the like; modified waxes such as montan wax derivatives, paraffin wax derivatives, micro-crystalline wax derivatives and the like; hydrogenated waxes such as castor wax, opal wax and the like; synthetic waxes such as low molecular weight polyethylene and its derivatives, acra wax, distearyl ketone and the like; saturated fatty acid amides such as capramide, capryamide, pelargonamide, capramide, lauramide, dodeamide, myrisamide, behenamide, stearamide, ethylenebis-stearamide and the like; and unsaturated fatty acid amides such as caproleamide, myristoleamide, oleamide, elaiamide, linolamide, erucamide, ricinoleamide, linoleamide and the like. These waxes may be used either alone or in combination.

The amount of the wax used in this invention is 3–15% by weight and preferably 4–10% by weight, based on the solid content in the aqueous coating color comprising microcapsules, protecting agent and binder. An amount less than 3% by weight is undesirable because with such an amount no marked effect can be exhibited on the improvement of transferability of color former.

On the other hand, an amount larger than 15% by weight is also undesirable because with such an amount the wax itself exercises a protecting action on the microcapsules in the coating layer and thereby lowers their transferability. In conclusion, an amount of 3–15% by weight can contribute to the improvement of transferability of color former.

As examples of the protecting agent usable in this invention, there can be referred to starches of wheat, corn, potato, sweet potato, tapioca, rice and the like; starch derivatives such as oxidized starch, acetylated starch and other esterified starches, etherified starches, aldehyde starch and the like; cellulose short fiber powder; glass beads; fine globules of polymers; and the like.

As examples of the binder, hydrophilic polymer colloids, starch, oxidized starch, casein, polyvinyl alcohol, carboxymethyl cellulose, water-soluble or -dispersible gums, latexes and the like can be referred to.

As the process for producing the color former coated sheet for the pressure sensitive copying paper of this invention, there are processes which comprise coating an aqueous coating color on the whole surface or a part of support by the use of usual coater such as air-knife coater or the like or a printing machine such as flexographic printing machine or the like. These processes may be selected arbitrarily in accordance with usage.

In this invention, various improving agents may be added at the time of preparing the aqueous coating color depending on the coater or printing machine used. Their examples include thickener for making viscosity constant, surfactant for improving dispersibility, and the like, though these are not limitative.

As the support on which the coating layer is formed in this invention, paper is used mainly, though various non-woven cloths, plastic films, synthetic papers and the like and composite sheets comprising their combination may also be used.

This invention will be illustrated more concretely with reference to the following examples, wherein parts are by weight.

EXAMPLE 1

(1) A dispersion of microcapsule containing color former was prepared in the following manner.

Thus, 80 parts of a solution of 3.5 parts of crystal violet lactone (CVL) and 1.5 parts of benzoyl leucomethylene blue (BLMB) in 1,1-diphenylethane was added to 100 parts of 5% aqueous solution of styrene-maleic anhydride copolymer containing a small quantity of sodium hdyroxide and having a pH value of 4.0, and emulsified to give an emulsion. On the other hand, a mixture comprising 10 parts of melamine, 25 parts of 37% aqueous solution of formaldehyde and 65 parts of water was adjusted to pH 9.0 with sodium hydroxide and heated to 60° C. The mixture became transparent in 15 minutes, and there was obtained a melamine-formaldehyde pre-condensate. The pre-condensate was added to the above-mentioned emulsion, the temperature was adjusted to 60° C. and stirring was continued. The formation of capsules was confirmed in 30 minutes, after which the mixture was cooled to room temperature. The microcapsule-containing dispersion thus obtained had a solid content of about 45%.

(2) Wheat starch as a protecting agent and oxidized starch as a binder were added to the microcapsule-containing dispersion prepared in (1), into which was then mixed 45% paraffin wax emulsion (commercial name: Mobil Cer C manufactured by Mobile Oil) in a proportion of 3, 5 or 10% by weight (solid weight) based on the total solid content of the above-mentioned fundamental formulation for color former coated sheet. The coating color thus obtained was coated on a paper having a basis weight of 50 g/m$^2$ by means of meyer bar, so as to give a constant color density of the dye.

The fundamental formulation expressed by solid content was as follows:

| | |
|---|---|
| microcapsule | 12 |
| wheat starch (protecting agent) | 30 |
| oxidized starch (binder) | 5 |

(3) The color former coated sheet prepared in (2) was superposed on a color developer sheet coated with p-phenylphenol resin, and pressure was applied by means of typewriter to develop a color. The color density of the blue color thus formed was as shown in Table 1.

COMPARATIVE EXAMPLE 1

Three kinds of coating colors were prepared which were the same as that in Example 1 except that the content of the paraffin wax emulsion was 0, 1 and 20% by weight, respectively. In the same manner as in Example 1, they were coated on paper and color was developed. The results were as shown in Table 1.

TABLE 1

| | Amount of wax (% by wt.) | Density of developed color | Rate of increase in color density (%) |
|---|---|---|---|
| Example 1-1 | 3 | 0.67 | 17.5 |
| Example 1-2 | 5 | 0.68 | 19.3 |
| Example 1-3 | 10 | 0.66 | 15.8 |
| Comparative Example 1-1 | 0 | 0.57 | — |
| Comparative Example 1-2 | 1 | 0.59 | 3.5 |
| Comparative Example 1-3 | 20 | 0.61 | 7.0 |

(Note)

$$\text{Rate of increase in color density} = \left(\frac{B - A}{A} \times 100\right)$$

Where

A: density of developed color in the case of fundamental formulation, and

B: density of developed color in the case of formulation containing a wax, provided that the densities of developed colors are optical densities measured with densitometer.

EXAMPLES 2-4 AND COMPARATIVE EXAMPLES 2-4

The experiment of Example 1 was repeated, except that the paraffin wax was replaced with various waxes. The results were as shown in Table 2.

TABLE 2

| | Wax | Amount of wax (% by wt.) | Density of developed color | Rate of increase in color density (%) |
|---|---|---|---|---|
| Example 2-1 | Japan wax | 3 | 0.64 | 12.3 |
| Example 2-2 | Japan wax | 7 | 0.65 | 14.0 |
| Example 2-3 | Japan wax | 10 | 0.64 | 12.3 |
| Example 3-1 | Micro-crystalline wax emulsion | 5 | 0.66 | 15.8 |
| Example 3-2 | Micro-crystalline wax emulsion | 10 | 0.63 | 10.5 |
| Example 4-1 | Montan wax | 7 | 0.66 | 15.8 |
| Example 4-2 | Montan wax | 12 | 0.65 | 14.0 |
| Comparative Example 2 | Japan wax | 2 | 0.58 | 1.8 |
| Comparative Example 3 | Micro-crystalline wax | 20 | 0.61 | 7.0 |
| Comparative Example 4 | Montan wax | 17 | 0.61 | 7.0 |

In Table 2, the calculation of the rate of increase in color density was based on the value of color density obtained in Comparative Example 1—1 for the fundamental formulation containing no wax.

It is apparent from the results shown in Tables 1 and 2 that, as compared with the case of fundamental formulation of Comparative Example 1—1, the rate of increase in color density is higher in the examples of this invention and particularly higher when the amount of wax is 5% by weight, so that the improving effect on the transferability of color former is clearly demonstrated.

What is claimed is:

1. A pressure sensitive copying paper comprising a color developer coated sheet obtained by coating a color developer on a support and a color former coated sheet obtained by coating on another support an aqueous coating color constituted mainly of (i) microcapsules containing a substantially colorless color former, (ii) a microcapsule-protecting agent and (iii) a binder selected from the group consisting of hydrophilic polymer colloids, starch, oxidized starch, casein, polyvinyl alcohol, carboxymethyl cellulose, water-soluble or dispersable gums and latexes and drying the coated aqueous coating color, wherein a wax in the form of an aqueous emulsion or aqueous suspension is added to said aqueous coating color in an amount of 3-15% by weight based on the solid content of the coating color.

2. A pressure sensitive copying paper according to claim 1, wherein said wax is added in an amount of 4-10% by weight.

* * * * *